United States Patent [19]

Naysmith

[11] 4,127,130

[45] Nov. 28, 1978

[54] AIR MUFFLER

[76] Inventor: Kenneth D. Naysmith, 724 Oak St., Wyandotte, Mich. 48192

[21] Appl. No.: 802,608

[22] Filed: Jun. 2, 1977

[51] Int. Cl.[2] ..... A62B 17/04

[52] U.S. Cl. ..... 128/142.7; 128/142.3; 181/230; 181/258; 181/224; 181/292; 55/276; 55/380; 285/397

[58] Field of Search ..... 128/142.7, 142.3, 142.4, 128/145.6; 181/230, 224, 258, 292; 55/276, 380; 285/417, 397, 398

[56] References Cited

U.S. PATENT DOCUMENTS

| | | | |
|---|---|---|---|
| 1,262,566 | 4/1918 | Rhodes et al. | 128/142.7 |
| 2,419,453 | 4/1947 | Kocevar | 285/397 |
| 3,596,441 | 8/1971 | Lundall | 55/380 |
| 3,601,219 | 8/1971 | Raschke | 181/230 |
| 3,927,668 | 12/1975 | Raschke | 128/142.7 |
| 4,052,984 | 10/1977 | Brockway | 128/142.7 |

*Primary Examiner*—Henry J. Recla

*Attorney, Agent, or Firm*—Cullen, Sloman, Cantor, Grauer, Scott & Rutherford

[57] ABSTRACT

The air muffler is primarily designed to be carried by a snug fitting hood respirator adapted to fit over the head of a person and to dispense breathable air into the hood in a minimum quantity of at least four cubic feet per minute, with a controlled noise level not to exceed 80 decibels, and with varying air pressure of from 11 to 25 pounds per square inch. The muffler utilizes a non-absorbent porous resilient fibrous filter media within a tubular casing provided with a series of ports, with the casing located entirely within a bag made from a non-absorbent porous fibrous material. An air pocket is provided between the portion of the casing provided with the ports and the bag. The air is directed from the source through the casing where it is restricted as it passes through the non-absorbent porous filter media prior to escaping through the ports in the casing into the air pocket where the air is muffled and is finally discharged into the hood through the porous fibrous bag.

18 Claims, 8 Drawing Figures

AIR MUFFLER

BACKGROUND OF THE PRESENT INVENTION

1. Field of the Invention

The air muffler or air muffler and diffuser may be used with air respirators, hood respirators or, as an example, with an air operated cylinder supplied with air by an air compressor. The muffler when used, as an example, with a hood respirator dispenses breathable and clean air to the hood in safe quantities and at acceptable noise levels without endangering the person's life or health.

2. Description of the Prior Art

The Federal Register of Mar. 25, 1972, Volume 37, No. 59, Part II, sets forth the U.S. Government NIOSH/MESA standards for the air supply device required in Supplied Air Respirators, of the Type C class. Such standards require in part that Type C Supplied Air Respirators must each have a minimum of 4 CFM of air at a stated (PSI) pressure and a noise level of 80 dBA or less delivered into the enclosed snug fitting hood respirators with a predetermined length of hose from the air source.

Various mufflers have been used heretofore with little success. In the past cotton filters and paper base fiber filters have been used in casings delivering air from the source to the hoods. Such materials absorbed moisture and the materials became packed in the end of the tubes or casings as a result of the air pressure against the diffusing fibers. This resulted in the ports of the casing becoming clogged and the filtering materials losing their air diffusing characteristics. Thus such devices after continued use do not normally meet the national standards and present a health problem since dusts, mists, fumes and other non-toxic particles are not filtered from the air supplied by the compressor. Unacceptable noise levels also result.

SUMMARY OF THE PRESENT INVENTION

It is a feature of the present invention to provide an appliance or muffler or air diffuser constructed to conform to the national standards relative to the delivery of clean air at acceptable noise levels without endangering the person's health.

It is a further feature of the present invention to provide a muffler capable of dispensing breathable clean air in a minimum quantity of at least 4 cubic feet per minute (4 CFM), with a controlled noise level not to exceed 80 dBA, and with varying air pressure from 11 to 25 (PSI) pounds per square inch delivered into an enclosure or hood covering a person's head.

A still further feature of the present invention is to provide a muffler containing a non-absorbent porous resilient fibrous filter media which removes moisture and many contaminants from the air which may be picked up by the generating source of air such as an air compressor prior to delivering same to the respirator. With such a construction the air is delivered at acceptable noise levels.

Another feature of the present invention is to provide a muffler having a flexible tubular elongated casing having a series of ports adjacent the closed end thereof, with the non-absorbent porous fibrous filter media being located in the casing in the same zone as the ports. With such a construction, the casing is located in a non-absorbent porous fibrous bag and forms an air pocket therebetween surrounding the portion of the casing provided with the ports. The open end of the casing is provided with a hose fitting and a clamp secures the open end of the bag to the casing and fitting to close the air pocket. Air, which is directed into the casing from the source, is initially restricted by the filter media where the air is cleaned prior to escaping through the ports in the casing into the air pocket where the air is muffled and finally discharged through the porous fibrous bag.

Still another feature of the present invention is to provide a muffler of the aforementioned type wherein the bag is of wedge shape configuration to assist in forming the air pocket with the casing; and is provided with double rows of stitches along the side edges and the closed end to prevent air from escaping from the air pocket except through the porous fabric material.

A further feature of the present invention is to provide a muffler of the aforementioned type wherein the non-absorbent porous resilient fibrous media is in the form of polyester fibers.

A still further feature of the present invention is to provide a muffler of the aforementioned type wherein the non-absorbent porous fibrous bag is made from a polypropylene fabric and the rows of stitches are made from polyester cotton threads which are also non-absorbent.

Another feature of the present invention is to provide a muffler which is simple in construction, is economical to manufacture and to maintain, and is efficient in operation.

DESCRIPTION OF A PREFERRED EMBODIMENT

Figure 1:
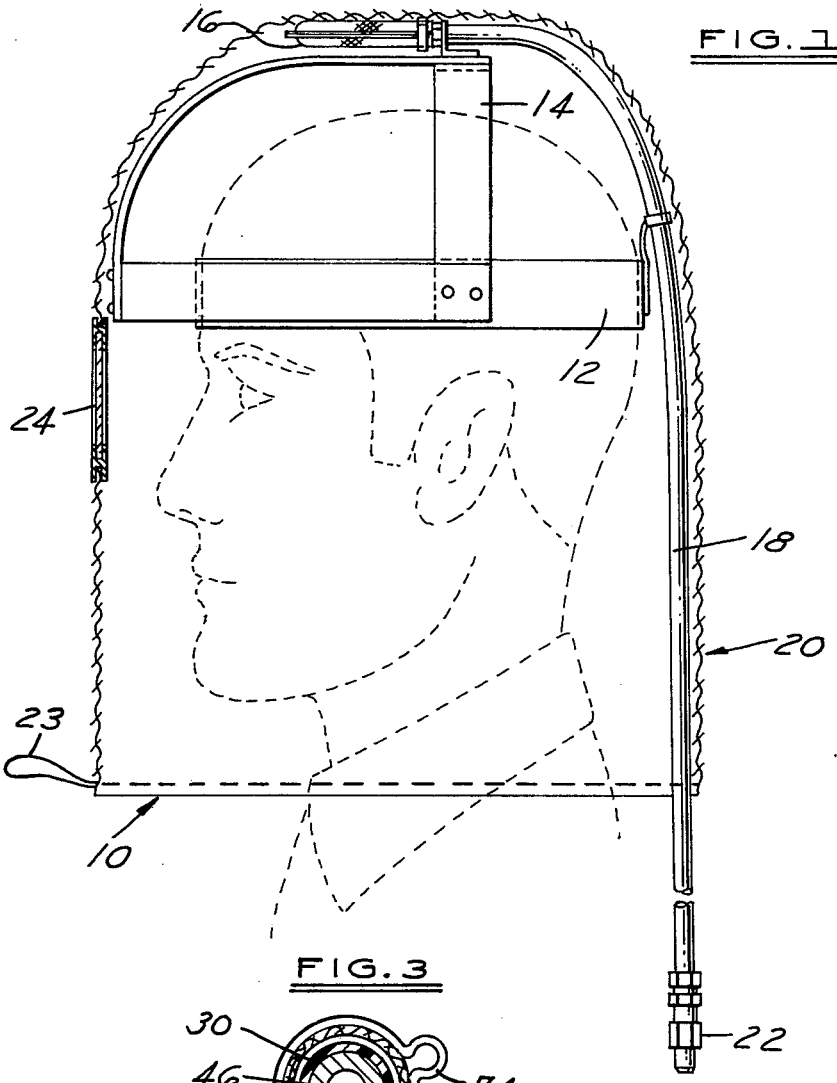
FIG. 1 is a view showing a hood respirator incorporating the muffler of the present invention.
Figure 3:
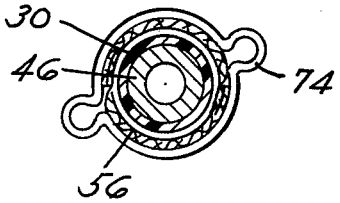
FIG. 3 is a sectional view taken on the line 3—3 of FIG. 2.

A hood respirator assembly 10 is illustrated in FIG. 1 on a person's head. Such respirator assemblies are designed for use under unusually dirty or dusty surroundings or when the concentration of overspray is heavier than usual. The respirator assemblies are not intended for use with toxic materials.

The hood respirator assembly 10 includes an adjustable head gear assembly 12 and frame 14 for supporting the muffler 16 and hose 18. A normally replaceable respirator hood 20 having a draw string 23 is inserted over the head gear assembly 12 and the components carried thereby as shown in FIG. 1. Air under pressure continually enters the hood 20 from an air supply hose, not shown, attached to fitting 22 provided on the hose 18. The air is cleaned and muffled in the muffler 16 prior to entering the interior of hood 20.

The hood 20 may be made, as an example, from paper, cloth, rubber coated fabric, vinyl plastic or other suitable material. Each hood 20 may be provided with a transparent acetate window 24 for viewing purposes. The pressurized air is exhausted from the hood in the usual manner.

The muffler 16 dispenses breathable clean air to the interior of hood 20 in a minimum quantity of at least 4 CFM, at controlled noise levels not to exceed 80 dBA and at varying air pressure from 11 to 25 PSI, all in accordance with the national standards. The muffler removes the dusts, mists, fumes and other non-toxic particles from the source of air.

Figure 2:
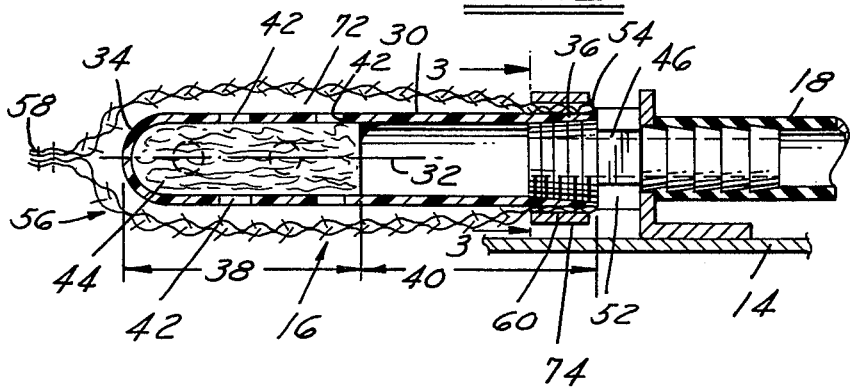
FIG. 2 is a longitudinal sectional view through the muffler attached to an air hose.

The muffler 16 includes an elongated generally cylindrical flexible tube or tubular casing 30 having a longitudinal axis 32 and which has a closed end 34 and a non-threaded opened end 36. The casing 30 throughout its length has an inner zone 38 and an outer zone 40 adjacent the closed end 34 and open end 36 respectively as shown in FIG. 2. The wall portion of casing 30 forming the inner zone 38 is provided with a series of longitudinally and circumferentially spaced ports 42. As an example, a total of eight ports 42 are provided. The ports 42 are arranged in four rows, with two ports 42 in each row. The casing 30 is made from a resilient material such as vinyl plastic.

Located within the casing 30 in the inner zone 38 is a non-absorbent porous resilient fibrous filter media or structure 44. The media 44 is made from polyester fibers which are arranged loosely in said inner zone 38 and form a non-woven filtering structure. The structure or media 44 has a density sufficient to restrict air flow and to assist in part in the controlling of the noise level. Specifically, the polyester fibers forming the filtering structure 44 weigh 0.75 gram. In use, the air pressure will tend to compact the fibers but the fibers will spring back due to the non-absorbent and resilient characteristics thereof.

A commercially available tubular hose fitting 46 is provided in the opened end 36 of casing 30 and includes an inner threaded portion 48 and an outer portion 50, which forms the barbed hose end. The inner and outer portions 48, 50 are separated by a hexagonal nut formation 52. The inner threaded portion 48 is received in the opened end 36 of casing 30. The surface 54 of nut formation 52 abuts the annular end surface 57 on casing 30. In some instances the opened end 36 of the casing 30 receives not only the inner threaded portion 48 of fitting 46 but also part or all of the nut formation 46. The outer hose formation 50 receives the end of hose 18.

A boot or bag 56 of wedged shape configuration has a closed end 58 and an opened end 60 through which the casing 30 is inserted into the bag 56. The bag 56 has a length greater than the length of casing 30. The bag 56 is made from a non-absorbent porous fibrous material such as polypropylene fabric. Excellent results have been obtained with a polypropylene fabric weighing 13 ounces per square yard; having a thread count of 68/43; and a porosity permitting air to escape into the hood at the rate of 10 to 13 CFM.

Figure 5:
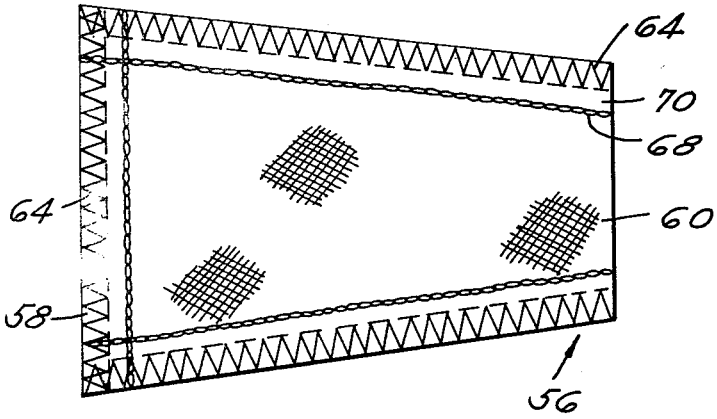
FIG. 5 is the assembled bag, showing the double rows of stitching.
Figure 4:
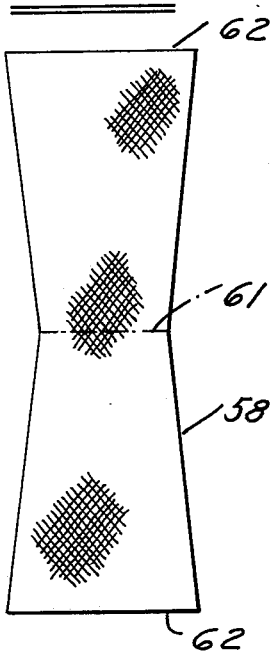
FIG. 4 is a plan view of the material used in forming the bag.
Figure 6:
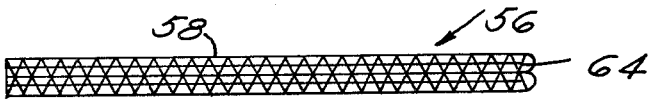
FIG. 6 is a side elevation of the assembled bag, showing the stitching required.
Figure 7:
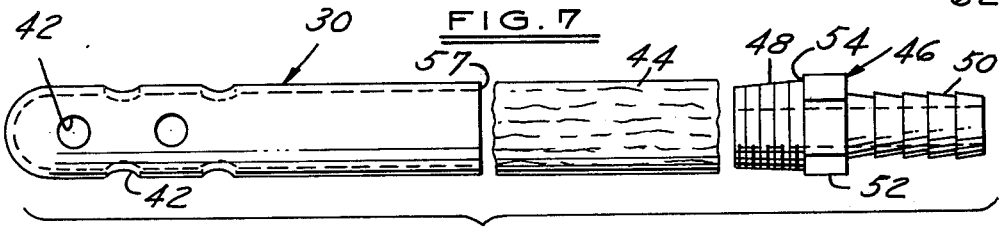
FIG. 7 is an elevational view of the tube or casing and the hose fitting.

The bag 56 is made from a pair of double layered fibrous panels or sheets 58, each cut into the form and wedge shape shown in FIG. 4. Each panel or sheet 58 is folded along the center line 61 so that the pair of end edges 62 overlap. Thereafter the two folded sheets 58 are superimposed on one another. The pair of panels each having two folded sheets 58 are then secured together by a stitching operation resulting in a row of continuous over edging or cast type stitches 64 extending along the sides and bottom of the bag 56 as shown in FIG. 5. The type of seam provided is a SSA-2, while the type of stitch is 515/516, 5 threads of a 40/20 size. Polyester cotton thread is utilized. Twelve stitches are provided per inch of seam. The row of continuous stitches 64 closes the bag 56 except at the opened end 60.

The bag 56 is also provided with a row of safety stitches 68 which is spaced inwardly from the other row of stitches 64 as shown in FIG. 5 and which extends along the sides and bottom of the bag 56. The safety stitches provide an additional seal for preventing the air in the interior of bag 56 from escaping at the seams. The row of safety stitches 68 utilize polyester cotton thread. Thus the rows of stitches 64, 68 are separated by a void or space 70.

The bag 56 and the assembled casing 30 therein cooperate to form an air pocket 72 which generally surrounds the inner zone 30 of the casing 30. The air pocket 72 is generally closed by a commercially available type of hose clamp 74 to be subsequently described. The air from the source is directed into the casing 30 where it is initially restricted as it passes through the non-absorbent filtering structure 44 prior to escaping through the ports 42 into the air pocket 72. The clean air is muffled in the bag 56 and is discharged through the porous fibrous bag 56 into the interior of hood 20.

The clamp 74 is of unitary construction and completely surrounds and engages the bag 56 and overlies the opened end portion of casing 30 and the fitting 46 as shown in FIG. 2. The bag 56 at the opened end 60 is folded or squeezed together and thereafter retained in that position by the clamp 74 to prevent air from escaping from the air pocket 72.

The present invention has many advantages over the prior air muffler which uses absorbent materials such as cotton and paper as the filtering structure. The muffler 16 serves as an air diffuser and has all of the required characteristics to deliver clean air to the enclosed hood in accordance with the aforementioned standards. In addition the polyester fiber filtering structure 44 will pick up the water from the air but will not absorb same thus permitting the structure 44 to maintain its resilient or bounce-back characteristics. The filtering structure also collects many contaminants which are transmitted in the air by the air compressor.

Test results show that muffler 16 delivers the required CFM's at the required dBA levels at any air pressure from 11 to 25 PSI at any distance from the air source up to 100 feet. The following results were obtained using a $\frac{3}{8}$ inch inside diameter of hose having a length of 100 feet:

| PSI | CFM | dBA | Weight of Polyester Fiber |
|---|---|---|---|
| 11 | 5 | 71 | $\frac{3}{4}$ gram |
| 25 | 8 | 78 | $\frac{3}{4}$ gram |

Varying the amount of polyester fiber 44 in the casing 30 produces different levels of CFM's at variable air pressures (PSI's). The polypropylene fabric density of the bag 56 also controls the dBA noise level in proportion to the supplied air pressure. The number of different combinations of polyester fiber fill and air pressures can produce varying muffling conditions which can be controlled at pre-set or built-in levels.

The polyester fiber when used as an air diffusing media within the vinyl casing 30, does not absorb moisture, which is usually present in air being delivered by the conventional air compressor. If the diffusing materials were to become absorbed by moisture such as a cotton or paper base fiber the diffusing characteristics would be lost due to a packing of the filler material in the end of the casing caused by the air pressure against the diffusing fibers.

The polypropylene fabric boot or bag construction is important to the CFM & dBA level of the muffler 16. The wedge shape design as shown in FIG. 5 permits the air to flow from within the casing 30 through the openings or ports 42 into an area (air pocket 72) around the exterior of the casing 30 and then out through the fabric. If the fabric were tight against the ports 42 in the casing 30 the noise level would increase beyond the dBA level limitations set by NIOSH. The construction of the stitching in the assembly of the bag 56 is also important. All air coming through the assembly must pass through the fabric bag 56 and not through the edges of the bag. In order to insure there is no air leak at the seams, the edges of the bag is provided with a row of safety stitches. To reduce the possibility of the threads becoming deteriorated, a synthetic fiber thread such as polyester cotton is preferable as it resists mildew and dry rot.

In the final assembly of the diffuser-muffler 16, the mechanical clamping device or clamp 74 is needed to insure the completed assembly will remain intact even under extreme mishandling, excessive air pressure or attempts to tamper or change the assembly which would change the air delivery characteristics. The complete assembly is secured with the ring type clamp 74 which has a holding pressure set and controlled by the manufacture at the time of final assembly.

The muffler may be used in combination with an air respirator, as an example, a snug fitting hood respirator adapted to fit over the head of a person as shown in FIG. 1.

Figure 8:
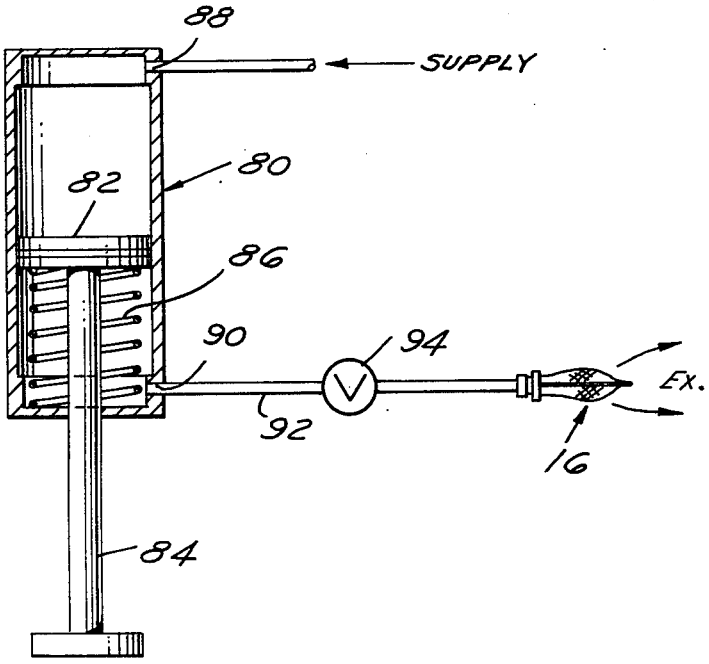
FIG. 8 illustrates the muffler of the present invention used with an air cylinder for muffling or dampening the air exhaust.

Also FIG. 8 illustrates the muffler 16 in combination with an air operated work cylinder 80 having a piston 82 and rod 84. A return spring 86 is located in the cylinder 80 and biases the piston 82 in one direction. The cylinder 80 at one end has an inlet or supply port 86 adapted to be connected to an air compressor, not shown. The cylinder 80 at the other end has an exhaust port 90 and an exhaust line or conduit 92 provided with the usual valve 94. The exhaust end of the conduit 92 is provided with the muffler 16. The muffler 16 muffles the exhaust air from cylinder 80 and discharges it within acceptable noise level limits to the surrounding atmosphere.

What is claimed is:

1. A muffler adapted to be connected to a source of air comprising a flexible tubular elongated casing having an axis, said casing having an opened end and a closed end and being divided into an outer zone and an inner zone throughout the length of said casing, said inner zone and said outer zone being located adjacent said closed end and opened end of said casing respectively, the wall of said casing surrounding said inner zone being provided with a series of ports which are spaced apart, a non-absorbent porous resilient fibrous filter media located within and throughout the inner zone of said casing, a fitting for said outer zone having one end mounted in the opened end of said casing and the opposite end extending therefrom in an axial direction away from said casing and adapted to be secured to the source of air, a bag closed at the one end and opened at the other end and made from a non-absorbent porous fibrous material, said casing extending into said bag through the opened end thereof, said bag and said casing cooperating to form an air pocket in said bag surrounding generally the inner zone of said casing, and a clamp surrounding and engaging said bag and overlying said fitting, said clamp securing said bag to the outer zone of said casing thus closing said air pocket, the air directed into said casing from the source being initially restricted as it passes through the non-absorbent porous filter media prior to escaping through the ports in said casing into said air pocket where the air is muffled and discharged through the porous fibrous bag.

2. The muffler defined in claim 1 wherein said non-absorbent porous resilient fibrous filter media includes polyester fibers.

3. The muffler defined in claim 1 wherein said non-absorbent porous resilient fibrous filter media is made entirely from polyester fibers.

4. The muffler defined in claim 3 wherein said polyester fibers are arranged loosely in said inner zone and form a non-woven filtering structure which has a density sufficient to restrict air flow and to assist in the controlling of the noise level.

5. The muffler defined in claim 1 wherein said non-absorbent porous fibrous bag is made from a polypropylene fabric.

6. The muffler defined in claim 5 wherein said polypropylene fabric weighs 13 ounces per square yard.

7. The muffler defined in claim 5 wherein said polypropylene fabric has a porosity permitting air to escape at the rate of 10 to 13 cubic feet per minute.

8. The muffler defined in claim 1 wherein said casing is made from a plastic material.

9. The muffler defined in claim 8 wherein said plastic material is vinyl.

10. The muffler defined in claim 1 wherein said fitting is of unitary tubular construction and includes inner and outer portions which are separated by a wrench formation, said inner portion being threaded and located in said opened end of said casing, said outer portion being adapted to fit within an air hose.

11. The muffler defined in claim 1 wherein said clamp is of unitary construction and completely surrounds and secures said bag to said casing.

12. The muffler defined in claim 1 wherein said bag, except at the opened end thereof, is closed along the side edges and the closed end thereof by a row of continuous stitches.

13. The muffler defined in claim 12 wherein said row of stitches is made from polyester cotton thread.

14. The muffler defined in claim 12 wherein said bag is provided with a row of safety stitches spaced inwardly from said row of continuous stitches, said row of safety stitches extending along the sides and closed end of said bag.

15. The muffler defined in claim 14 wherein said row of safety stitches is made from polyester cotton thread.

16. The muffler defined in claim 12 wherein said bag is of wedge shape configuration, with the smallest end thereof corresponding to the opened end of said bag, and with the largest end thereof being closed and spaced from the closed end of said casing to form part of said air pocket.

17. The muffler defined in claim 1 in combination with a snug fitting hood respirator adapted to fit over the head of a person said muffler being mounted within said hood.

18. The muffler defined in claim 1 in combination with an air operated cyclinder having an exhaust port supplied with air by a compressor, said opposite end of said fitting being connected to said exhaust port.

* * * * *